US009760048B2

(12) United States Patent
Dooley et al.

(10) Patent No.: US 9,760,048 B2
(45) **Date of Patent: *Sep. 12, 2017**

(54) SURFACE COATING AND FUSER MEMBER

(71) Applicant: Xerox Corporation, Norwalk, CT (US)

(72) Inventors: Brynn M. Dooley, Toronto (CA); Yu Qi, Oakville (CA); Edward G. Zwartz, Mississiauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 837 days.

This patent is subject to a terminal disclaimer.

(21) Appl. No.: 13/870,437

(22) Filed: Apr. 25, 2013

(65) Prior Publication Data

US 2014/0323005 A1 Oct. 30, 2014

(51) Int. Cl.
*G03G 15/20* (2006.01)

(52) U.S. Cl.
CPC ..... *G03G 15/2057* (2013.01); *Y10T 442/60* (2015.04); *Y10T 442/626* (2015.04); *Y10T 442/674* (2015.04)

(58) Field of Classification Search
USPC ..... 492/53; 442/51, 52, 327, 340, 333, 374; 399/320, 333, 352; 428/213, 215, 216, 428/220, 429; 427/58
See application file for complete search history.

(56) References Cited

U.S. PATENT DOCUMENTS 4,887,340 A * 12/1989 Kato ..... B29C 70/28 492/53
8,257,641 B1 * 9/2012 Qi ..... G03G 15/2057 264/172.15
8,781,383 B2 * 7/2014 Qi ..... B82Y 30/00 399/333
2012/0156481 A1 * 6/2012 Moorlag et al. ..... 428/339
2012/0208421 A1 * 8/2012 Qi ..... G03G 15/2057 442/334
2012/0224897 A1 * 9/2012 Qi ..... B82Y 30/00 399/333
2012/0225602 A1 * 9/2012 Qi ..... C08G 73/1039 442/365
2013/0178568 A1 * 7/2013 Meuler ..... C09D 5/1625 524/269
2014/0154512 A1 * 6/2014 Dooley et al. ..... 428/411.1

* cited by examiner

*Primary Examiner* — Lynda Salvatore
(74) *Attorney, Agent, or Firm* — Hoffman Warnick LLC

(57) ABSTRACT

Described is a fuser member having a substrate and a surface layer disposed on the substrate. The surface layer includes a non-woven polymer fiber matrix having dispersed throughout a siloxyfluorocarbon (SFC) networked polymer and a fluorinated polyhedral oligomeric silsesquioxane.

19 Claims, 5 Drawing Sheets

SURFACE COATING AND FUSER MEMBER

CROSS REFERENCE TO RELATED APPLICATIONS

This application relates to commonly assigned copending application Ser. No. 13/870,432 entitled "Surface Coating and Fuser Member."

BACKGROUND

Field of Use

This disclosure is generally directed to surface layers for fuser members useful in electrophotographic imaging apparatuses, including digital, image on image, and the like.

Background

Fluoroplastics such as polytetrafluoroethylene (PTFE, e.g. Teflon®) or perfluoroalkyl resin (PFA) are currently used as fuser topcoat materials for oil-less fusing. Fluoroplastics are mechanically rigid and are easily damaged. In addition, fluoroplastics are difficult to process due to their high melting temperatures (>300° C.) and insolubility in a variety of solvents. The high baking temperature often causes surface defects during fabrication as the under coat layer degrades at the high melting temperatures. There is a need to develop a fuser topcoat material that can be easily processed and cured at low temperatures (i.e., <260° C.) while maintaining sustained toner release performance.

A coating having a low surface energy that is durable and easily manufactured is desirable.

SUMMARY

According to an embodiment, there is described a fuser member having a substrate and a release layer disposed on the substrate. The surface layer includes a non-woven polymer fiber matrix having dispersed throughout a siloxyfluorocarbon (SFC) networked polymer and a fluorinated polyhedral oligomeric silsesquioxane.

According to another embodiment, there is provided a fuser member having a substrate an intermediate layer disposed on the substrate and a surface layer disposed on the intermediate layer. The surface layer includes a non-woven polyimide fiber matrix having dispersed throughout a siloxyfluorocarbon (SFC) networked polymer and a fluorinated polyhedral oligomeric silsesquioxane. The siloxyfluorocarbon networked polymer is formed from siloxyfluorocarbon monomers represented by:

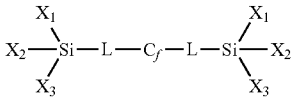

wherein $C_f$ is a linear aliphatic or aromatic fluorocarbon chain having from 2 to 40 carbon atoms; L is a $C_nH_{2n}$ group, where n is a number between 0 and about 10; and $X_1$, $X_2$, and $X_3$ are reactive hydroxide functionalities, reactive alkoxide functionalities, unreactive aliphatic functionalities of from about 1 carbon atom to about 10 carbon atoms, unreactive aromatic functionalities of from about 1 carbon atom to 10 carbon atoms. All the siloxyfluorocarbon monomers are bonded together via silicon oxide (Si—O—Si) linkages in a single system. The siloxyfluorocarbon networked polymer is insoluble in solvents selected from the group consisting of ketones, chlorinated solvents and ethers. The fluorinated polyhedral oligomeric silsesquioxane is represented by:

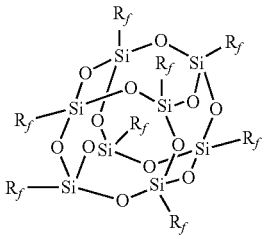

wherein $R_f$ is a linear aliphatic or aromatic fluorocarbon chain having from 2 to 40 carbon atoms.

According to another embodiment, there is provided a fuser member that includes a substrate, a silicone layer disposed on the substrate and a surface layer disposed on the silicone layer. The surface layer includes a non-woven polyimide fiber matrix wherein the polyimide fibers comprise the following chemical structure:

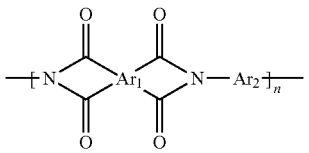

wherein $Ar_1$ and $Ar_2$ independently represent an aromatic group of from about 4 carbon atoms to about 100 carbon atoms; and at least one of $Ar_1$ and $Ar_2$ further contains a fluoro-pendant group wherein n is from about 30 to about 500. Dispersed throughout the polyimide fiber matrix is a siloxyfluorocarbon (SFC) networked polymer and a polyhedral oligomeric silsesquioxane.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
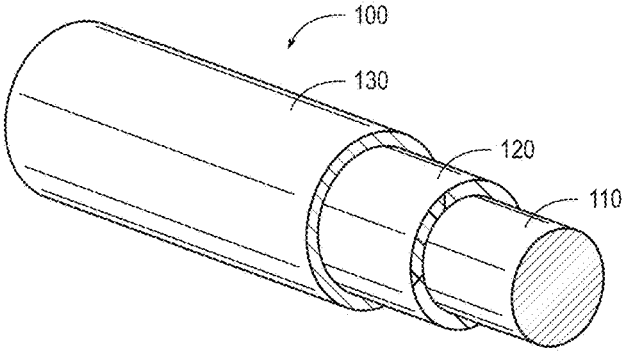
FIG. 1 depicts an exemplary fusing member having a cylindrical substrate in accordance with the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Disclosed herein is a surface layer for a fuser member. The surface layer includes a non-woven matrix of polymer fibers wherein the polymer fibers have are surrounded by a coating or sheath of a fluoropolymer. A networked siloxyfluorocarbon polymer is dispersed throughout the non-woven matrix. In an embodiment a surface layer of networked siloxyfluorocarbon polymer is supported on a non-woven matrix of polymer fibers wherein the polymer fibers are surrounded by a coating or sheath a sheath of a fluoropolymer and a siloxyfluorocarbon is dispersed throughout the non-woven matrix.

In U.S. Ser. No. 13/040,568 filed on Mar. 4, 2011, incorporated in its entirety by reference herein, a fuser sleeve is described. The fuser sleeve is a fluoropolymer dispersed in a plurality of non-woven polymer fibers wherein the polymer fibers have a diameter of from about 5 nm to about 50 μm. The fluoropolymer described in U.S. Ser. No. 13/040,568 requires high temperature processing.

Polyimide membranes comprising a mat of non-woven polyimide fibers having a fluoropolymer sheath are described in U.S. Ser. No. 13/444,366 filed on Apr. 11, 2012 and incorporated in its entirety by reference herein. Polyimide membranes comprising a mat of non-woven polyimide and siloxyfluorocarbon are described in U.S. Ser. No. 13/706,027 filed on Dec. 5, 2013 and incorporated in its entirety by reference herein.

As used herein, the term "hydrophobic/hydrophobicity" and the term "oleophobic/oleophobicity" refer to the wettability behavior of a surface that has, e.g., a water and hexadecane (or hydrocarbons, silicone oils, etc.) contact angle of approximately 90° or more, respectively. For example, on a hydrophobic/oleophobic surface, a ~10-15 μL water/hexadecane drop can bead up and have an equilibrium contact angle of approximately 90° or greater.

As used herein, the term "ultrahydrophobicity/ultrahydrophobic surface" and the term "ultraoleophobic/ultraoleophobicity" refer to wettability of a surface that has a more restrictive type of hydrophobicity and oleophobicity, respectively. For example, the ultrahydrophobic/ultraoleophobic surface can have a water/hexadecane contact angle of about 120° or greater.

The term "superhydrophobicity/superhydrophobic surface" and the term "superoleophobic/superoleophobicity" refer to wettability of a surface that has an even more restrictive type of hydrophobicity and oleophobicity, respectively. For example, a superhydrophobic/superoleophobic surface can have a water/hexadecane contact angle of approximately 150 degrees or greater and have a ~10-15 μL water/hexadecane drop roll freely on the surface tilted a few degrees from level. The sliding angle of the water/hexadecane drop on a superhydrophobic/superoleophobic surface can be about 10 degrees or less. On a tilted superhydrophobic/superoleophobic surface, since the contact angle of the receding surface is high and since the interface tendency of the uphill side of the drop to stick to the solid surface is low, gravity can overcome the resistance of the drop to slide on the surface. A superhydrophobic/superoleophobic surface can be described as having a very low hysteresis between advancing and receding contact angles (e.g., 40 degrees or less). Note that larger drops can be more affected by gravity and can tend to slide easier, whereas smaller drops can tend to be more likely to remain stationary or in place.

As used herein, the term "low surface energy" and the term "very low surface energy" refer to ability of molecules to adhere to a surface. The lower the surface energy, the less likely a molecule will adhere to the surface. For example, the low surface energy is characterized by a value of about 20 mN/m or less, very low surface energy is characterized by a value of about 10 mN/m or less.

In various embodiments, the fixing member can include, for example, a substrate, with one or more functional layers formed thereon. The substrate can be formed in various shapes, e.g., a cylinder (e.g., a cylinder tube), a cylindrical drum, a belt, or a film, using suitable materials that are non-conductive or conductive depending on a specific configuration, for example, as shown in FIGS. 1 and 2.

Figure 2:
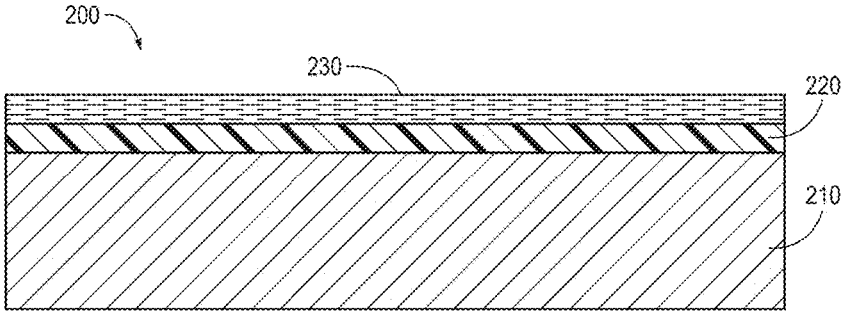
FIG. 2 depicts an exemplary fusing member having a belt substrate in accordance with the present teachings.

Specifically, FIG. 1 depicts an exemplary fixing or fusing member 100 having a cylindrical substrate 110 and FIG. 2 depicts in cross-section another exemplary fixing or fusing member 200 having a belt substrate 210 in accordance with the present teachings. It should be readily apparent to one of ordinary skill in the art that the fixing or fusing member 100 depicted in FIG. 1 and the fixing or fusing member 200 depicted in FIG. 2 represent generalized schematic illustrations and that other layers/substrates can be added or existing layers/substrates can be removed or modified.

In FIG. 1, the exemplary fixing member 100 can be a fuser roller having a cylindrical substrate 110 with one or more functional layers 120 (also referred to as intermediate layers) and a surface layer 130 formed thereon. In embodiments detailed herein the surface layer 130 can be two distinct layers. This is not shown in FIG. 1. In various embodiments, the cylindrical substrate 110 can take the form of a cylindrical tube, e.g., having a hollow structure including a heating lamp therein, or a solid cylindrical shaft. In FIG. 2, the exemplary fixing member 200 can include a belt substrate 210 with one or more functional layers, e.g., 220 and an outer surface 230 formed thereon. In embodiments detailed herein the surface layer 230 can be two distinct layers. This is not shown in FIG. 2.

Substrate Layer

The belt substrate 210 (FIG. 2) and the cylindrical substrate 110 (FIG. 1) can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes) and metal materials (e.g., aluminum or stainless steel) to maintain rigidity and structural integrity as known to one of ordinary skill in the art.

Intermediate Layer

Examples of intermediate or functional layers 120 (FIG. 1) and 220 (FIG. 2) include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Examples of intermediate or functional layers 120 (FIG. 1) and 220 (FIG. 2) also include fluoroelastomers. Fluoroelastomers are from the class of 1) copolymers of two of vinylidenefluoride, hexafluoropropylene, and tetrafluoroethylene; such as those known commercially as VITON A®, 2) terpolymers of vinylidenefluoride, hexafluoropropylene, and tetrafluoroethylene such as those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS® a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505®, available from Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer. Cure site monomers are available from Dupont.

For a roller configuration, the thickness of the intermediate or functional layer can be from about 0.5 mm to about 10 mm, or from about 1 mm to about 8 mm, or from about 2 mm to about 7 mm. For a belt configuration, the functional layer can be from about 25 microns up to about 2 mm, or from 40 microns to about 1.5 mm, or from 50 microns to about 1 mm.

Release Layer or Surface Layer

Disclosed herein is a siloxyfluorocarbon (SFC) networked polymer and a fluorinated polyhedral oligomeric silsesquioxane (POSS) composite material dispersed throughout a non-woven matrix of electrospun fibers for use as a fuser topcoat. The non-woven matrix of electrospun fibers provides the framework for the mechanical robustness, surface texture, and is the host for the self-release composition of the SFC/POSS composite material. The POSS reduces surface free energy of the siloxyfluorocarbon matrix and acts as an internal release agent. When the surface of the topcoat is exposed to damage, the damage to the surface can be repaired by the application heat. Because fuser members release layers are subjected to heat during operation, the disclosed release layer is able to repair itself and maintain its surface properties under fusing conditions.

Disclosed herein is a release layer or surface layer that includes a non-woven matrix of polymer fibers, wherein a siloxyfluorocarbon networked polymer and a fluorinated polyhedral oligomeric silsesquioxane is dispersed throughout the non-woven matrix. In embodiments, the polymer fibers are surrounded by a coating or sheath of a fluoropolymer. In an embodiment, the release layer includes two distinct layers (shown in FIG. 7) a surface layer of networked siloxyfluorocarbon polymer which is supported on a non-woven matrix of polymer fibers wherein the polymer fibers are surrounded by a coating or sheath a sheath of a fluoropolymer and a networked siloxyfluorocarbon is dispersed throughout the non-woven matrix. The fibers provide support for the siloxyfluorocarbon polymer network when the siloxyfluorocarbon is dispersed throughout the non-woven matrix. The non-woven matrix provides support for the siloxyfluorocarbon networked polymer and POSS. The core-sheath fibers of a polymer core and a fluoropolymer sheath improve the mechanical properties of the surface of the fuser, particularly flexibility, without affecting toner release. The non-woven matrix of polymer fibers and having a networked siloxyfluorocarbon polymer dispersed throughout has a thickness of from about 10 μm to about 400 μm, or from about 20 μm to about 300 μm, or from about 25 μm to about 200 μm. In embodiments, there is a second layer of siloxyfluorcarbon polymer on the non-woven matrix of polymer fibers, which has a thickness of from about 1 μm to about 200 μm, or from about 5 μm to about 100 μm, or from about 10 μm to about 80 μm.

Additives and additional conductive or non-conductive fillers may be present in the substrate layers 110 (FIG. 1) and 210 (FIG. 2), the intermediate layers 120 (FIG. 1) and 220 (FIG. 2) and the release layers 130 (FIG. 1) and 230 (FIG. 2). In various embodiments, other filler materials or additives including, for example, inorganic particles, can be used for the coating composition and the subsequently formed surface layer. Conductive fillers used herein may include carbon blacks such as carbon black, graphite, graphene, alumina, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly(p-phenylene sulfide), pyrroles, polyindole, polypyrene, polycarbazole, polyazulene, polyazepine, poly (fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

Adhesive Layer

Optionally, any known and available suitable adhesive layer may be positioned between the outer layer or surface layer and the intermediate layer or between the intermediate layer and the substrate layer. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. The adhesive layer can be coated on the substrate, or on the outer layer, to a thickness of from about 2 nanometers to about 10,000 nanometers, or from about 2 nanometers to about 1,000 nanometers, or from about 2 nanometers to about 5000 nanometers. The adhesive can be coated by any suitable known technique, including spray coating or wiping.

Figure 3A:
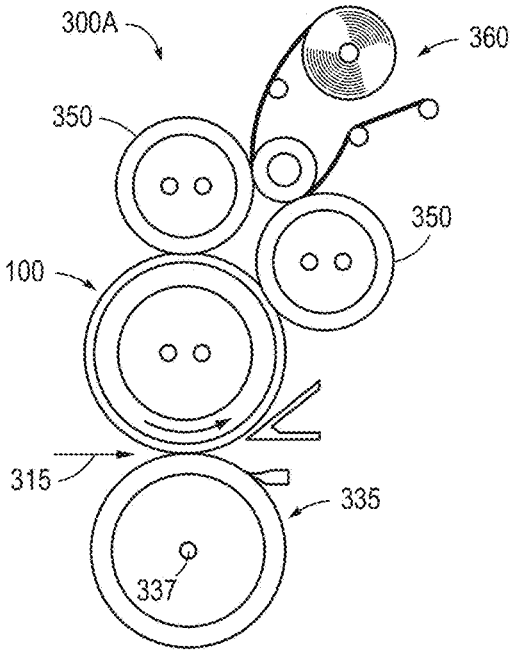
FIGS. 3A-3B depict exemplary fusing configurations using the fuser rollers shown in FIG. 1 in accordance with the present teachings.
Figure 3B:
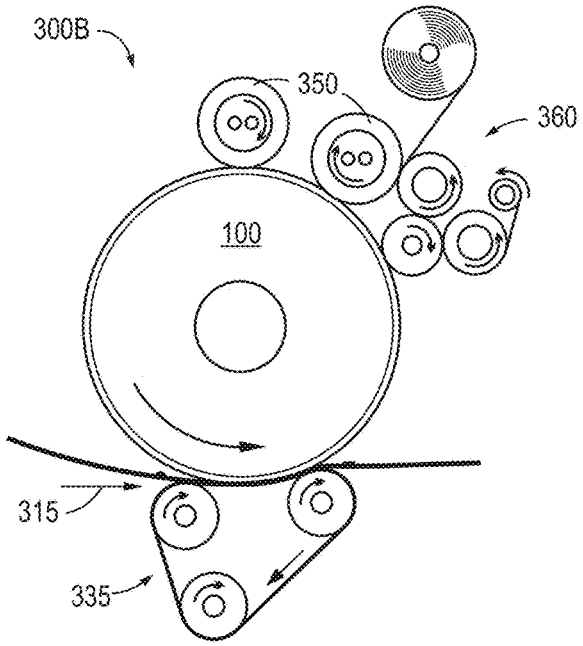
Figure 4A:
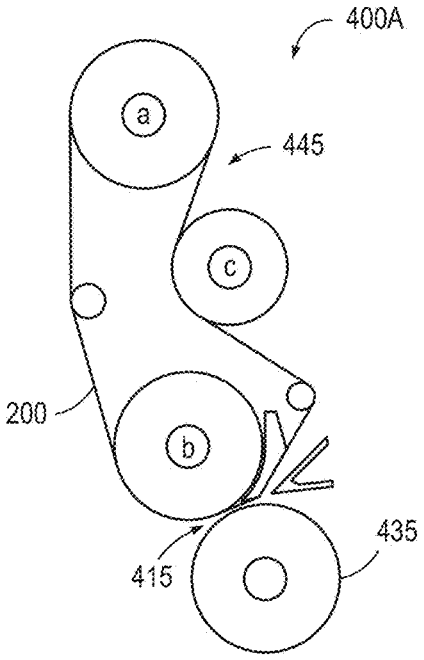
FIGS. 4A-4B depict another exemplary fusing configuration using the fuser belt shown in FIG. 2 in accordance with the present teachings.
Figure 4B:
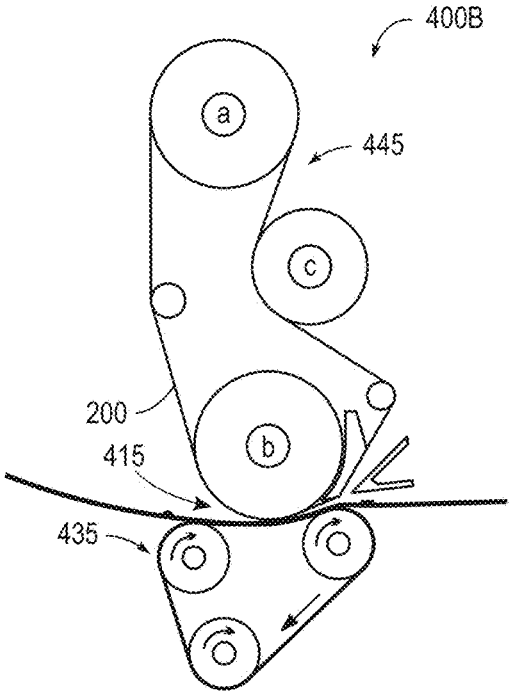

FIGS. 3A-3B and FIGS. 4A-4B depict exemplary fusing configurations for the fusing process in accordance with the present teachings. It should be readily apparent to one of ordinary skill in the art that the fusing configurations 300A-B depicted in FIGS. 3A-3B and the fusing configurations 400A-B depicted in FIGS. 4A-4B represent generalized schematic illustrations and that other members/layers/substrates/configurations can be added or existing members/layers/substrates/configurations can be removed or modified. Although an electrophotographic printer is described herein, the disclosed apparatus and method can be applied to other printing technologies. Examples include offset printing and inkjet and solid ink transfix machines.

FIGS. 3A-3B depict the fusing configurations 300A-B using a fuser roller shown in FIG. 1 in accordance with the present teachings. The configurations 300A-B can include a fuser roller 100 (i.e., 100 of FIG. 1) that forms a fuser nip with a pressure applying mechanism 335, such as a pressure roller in FIG. 3A or a pressure belt in FIG. 3B, for an image supporting material 315. In various embodiments, the pressure applying mechanism 335 can be used in combination with a heat lamp 337 to provide both the pressure and heat for the fusing process of the toner particles on the image supporting material 315. In addition, the configurations 300A-B can include one or more external heat roller 350 along with, e.g., a cleaning web 360, as shown in FIG. 3A and FIG. 3B.

FIGS. 4A-4B depict fusing configurations 400A-B using a fuser belt shown in FIG. 2 in accordance with the present teachings. The configurations 400A-B can include a fuser belt 200 (i.e., 200 of FIG. 2) that forms a fuser nip with a pressure applying mechanism 435, such as a pressure roller in FIG. 4A or a pressure belt in FIG. 4B, for a media substrate 415. In various embodiments, the pressure applying mechanism 435 can be used in a combination with a heat lamp to provide both the pressure and heat for the fusing process of the toner particles on the media substrate 415. In addition, the configurations 400A-B can include a mechanical system 445 to move the fuser belt 200 and thus fusing the toner particles and forming images on the media substrate 415. The mechanical system 445 can include one or more rollers 445*a-c*, which can also be used as heat rollers when needed.

Figure 5:
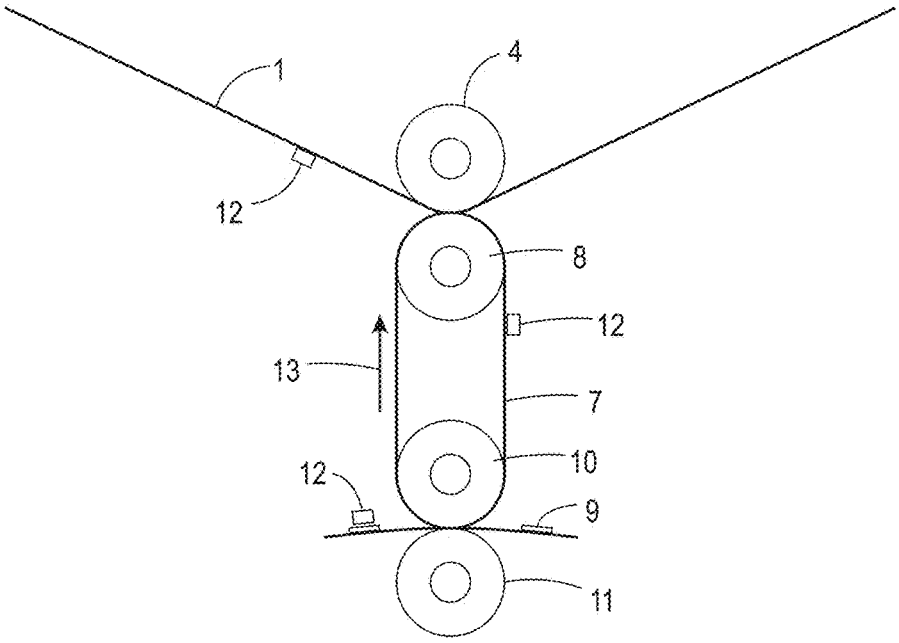
FIG. 5 depicts an exemplary fuser configuration using a transfix apparatus.

FIG. 5 demonstrates a view of an embodiment of a transfix member 7 which may be in the form of a belt, sheet, film, or like form. The transfix member 7 is constructed similarly to the fuser belt 200 described above. The developed image 12 positioned on intermediate transfer member 1 is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

The siloxyfluorocarbon (SFC) networked polymer and a fluorinated polyhedral oligomeric silsesquioxane (POSS) composite material dispersed throughout a non-woven matrix of electrospun fibers for use as a fuser topcoat is described in more detail below.

The fuser surface layer includes a non-woven matrix of polymer fibers. In embodiments, the polymer fibers are surrounded by a coating or sheath of a fluoropolymer. A networked siloxyfluorocarbon polymer is dispersed throughout the non-woven matrix. In an embodiment, the release layer is comprised of a non-woven matrix of polymer fibers. The polymer fibers can be surrounded by a coating or sheath of a fluoropolymer in such a configuration. The siloxyfluorocarbon (SFC) networked polymer and a fluorinated polyhedral oligomeric silsesquioxane (POSS) composite material is dispersed throughout a non-woven matrix of non-woven fibers for use as a fuser topcoat (shown in FIG. 6). In another embodiment, the release layer includes two distinct layers, a surface layer of networked siloxyfluorocarbon polymer which is supported on a non-woven matrix of polymer fibers and a networked siloxyfluorocarbon is dispersed throughout the non-woven matrix. The polymer fibers can be surrounded by a coating or sheath of a fluoropolymer in such a configuration.

Nonwoven fabrics are broadly defined as sheet or web structures bonded together by entangling fiber or filaments (and by perforating films) mechanically, thermally or chemically. They include flat, porous sheets that are made directly from separate fibers or from molten plastic or plastic film. They are not made by weaving or knitting and do not require converting the fibers to yarn. Compared to the conventional non-woven fabrics, the fabrics described herein have the advantages of high surface area for strong interaction between the fabrics and the filler polymer, high loading in the composite coating (>50%), uniform, well-controlled morphology and very low surface energy.

The fuser topcoat is fabricated by applying the polymer fibers onto a substrate by an electrospinning process. Electrospinning uses an electrical charge to draw very fine (typically on the micro or nano scale) fibers from a liquid. The charge is provided by a voltage source. The process does not require the use of coagulation chemistry or high temperatures to produce solid threads from solution. This makes the process particularly suited to the production of fibers using large and complex molecules such as polymers. When a sufficiently high voltage is applied to a liquid droplet, the body of the liquid becomes charged, and electrostatic repulsion counteracts the surface tension and the droplet is stretched. At a critical point a stream of liquid erupts from the surface. This point of eruption is known as the Taylor cone. If the molecular cohesion of the liquid is sufficiently high, stream breakup does not occur and a charged liquid jet is formed.

Electrospinning provides a simple and versatile method for generating ultrathin fibers from a rich variety of materials that include polymers, composites and ceramics. To date, numerous polymers with a range of functionalities have been electrospun as nanofibers. In electrospinning, a solid fiber is generated as the electrified jet (composed of a highly viscous polymer solution with a viscosity range of from about 1 to about 400 centipoises, or from about 5 to about 300 centipoises, or from about 10 to about 250 centipoises) is continuously stretched due to the electrostatic repulsions between the surface charges and the evaporation of solvent. Suitable solvents include dimethylformamide, dimethylacetamide, 1-methyl-2-pyrrolidone, tetrahydrofuran, a ketone such as acetone, methylethylketone, dichloromethane, an alcohol such as ethanol, isopropyl alcohol, water and mixtures thereof. The weight percent of the polymer in the solution ranges from about 1 percent to about 60 percent, or from about 5 percent to about 55 percent to from about 10 percent to about 50 percent.

Exemplary materials used for the electrospun fiber with or without a fluoropolymer sheath can include: polyamide such as aliphatic and/or aromatic polyamide, polyester, polyimide, fluorinated polyimide, polycarbonate, polyurethane, polyether, polyoxadazole, polybenzimidazole, polyacrylonitrile, polycaprolactone, polyethylene, polypropylenes, acrylonitrile butadiene styrene (ABS), polybutadiene, polystyrene, polymethyl-methacrylate (PMMA), poly(vinyl alcohol), poly(ethylene oxide), polylactide, poly(caprolactone), poly(ether imide), poly(ether urethane), poly(arylene ether), poly(arylene ether ketone), poly(ester urethane), poly (p-phenylene terephthalate), cellulose acetate, poly(vinyl acetate), poly(acrylic acid), polyacrylamide, polyvinylpyrrolidone, hydroxypropylcellulose, poly(vinyl butyral), poly (alkly acrylate), poly(alkyl methacrylate), polyhydroxybutyrate, fluoropolymer, poly(vinylidene fluoride), poly (vinylidene fluoride-co-hexafluoropropylene), fluorinated ethylene-propylene copolymer, poly(tetrafluoroethylene-co-perfluoropropyl vinyl ether), poly((perfluoroalkyl)ethyl methacrylate), cellulose, chitosan, gelatin, protein, and mixtures thereof. In embodiments, the electrospun fibers can be formed of a tough polymer such as Nylon, polyimide, and/or other tough polymers.

Exemplary materials used for the electrospun fibers when there is no sheath or coating include fluoropolymers selected from the group consisting of: copolymers of vinylidenefluoride, hexafluoropropylene and tetrafluoropropylene and tetrafluoroethylene; terpolymers of vinylidenefluoride, hexafluoropropylene and tetrafluoroethylene; tetrapolymers of vinylidenefluoride, hexafluoropropylene, tetrafluoroethylene, and a cure site monomer; polytetrafluoroethylene (PTFE); perfluoroalkoxy polymer resin (PFA); copolymers of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP) and a cure site monomer.

In embodiments, fluorinated polyimides (FPI) are used for the core with or without a sheath of the polymers in the non-woven matrix layer. Fluorinated polyimides are synthesized in high molecular weight using a known procedure as shown in Equation 1.

Equation 1

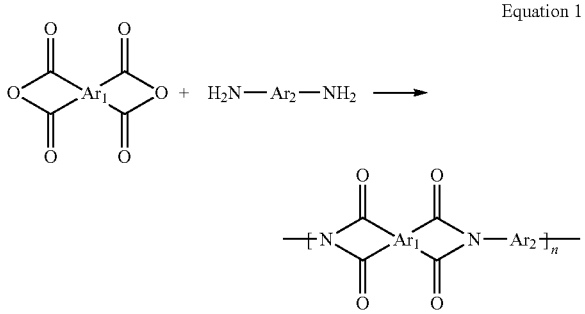

wherein one of wherein $Ar_1$ and $Ar_2$ independently represent an aromatic group of from about 4 carbon atoms to about 60 carbon atoms; and at least one of $Ar_1$ and $Ar_2$ further contains fluorine. In the polyimide above, n is from about 30 to about 500, or from about 40 to about 450 or from about 50 to about 400.

More specific examples of fluorinated polyimides include the following general formula:

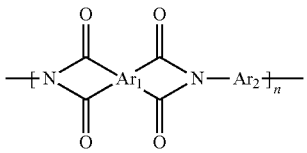

wherein $Ar_1$ and $Ar_2$ independently represent an aromatic group of from about 4 carbon atoms to about 100 carbon atoms, or from about 5 to about 60 carbon atoms, or from about 6 to about 30 carbon atoms such as such as phenyl, naphthyl, perylenyl, thiophenyl, oxazolyl; and at least one of $Ar_1$ and $Ar_2$ further contains a fluoro-pendant group. In the polyimide above, n is from about 30 to about 500, or from about 40 to about 450 or from about 50 to about 400.

$Ar_1$ and $Ar_2$ can represent a fluoroalkyl having from about 4 carbon atoms to about 100 carbon atoms, or from about 5 carbon atoms to about 60 carbon atoms, or from about 6 to about 30 carbon atoms.

In embodiments, the electrospun fibers can have a diameter ranging from about 5 nm to about 50 μm, or ranging from about 50 nm to about 20 μm, or ranging from about 100 nm to about 1 μm. In embodiments, the electrospun fibers can have an aspect ratio about 100 or higher, e.g., ranging from about 100 to about 1,000, or ranging from about 100 to about 10,000, or ranging from about 100 to about 100,000. In embodiments, the non-woven fabrics can be non-woven nano-fabrics formed by electrospun nanofibers having at least one dimension, e.g., a width or diameter, of less than about 1000 nm, for example, ranging from about 5 nm to about 500 nm, or from 10 nm to about 100 nm. In embodiments, the non-woven fibers comprise from about 10 weight percent to about 50 weight percent of the release layer. In embodiments, the non-woven fibers comprise from about 15 weight percent to about 40 weight percent, or from about 20 percent to about 30 weight percent of the release layer.

In embodiments, the sheath on the polymer fibers is formed by coating the polymer fiber core with a fluoropolymer and heating the fluoropolymer. The fluoropolymers have a curing or melting temperature of from about 150° C. to about 360° C. or from about 280° C. to about 330° C. The thickness of the sheath can be from about 10 nm to about 200 microns, or from about 50 nm to about 100 microns or from about 200 nm to about 50 microns.

In an embodiment core-sheath polymer fiber can be prepared by co-axial electrospinning of polymer core and the fluoropolymer (such as Viton) to form the non-woven core-sheath polymer fiber layer.

Examples of fluoropolymers useful as the sheath or coating of the polymer fiber include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and a cure site monomer. These fluoroelastomers are known commercially under various designations such as VITON A®, VITON B®, VITON E®, VITON E 60C® VITON E430® VITON 910®, VITON GH®; VITON GF®; and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505, available from Solvay Solexis.

Examples of three known fluoroelastomers are (1) a class of copolymers of two of vinylidenefluoride, hexafluoropropylene, and tetrafluoroethylene, such as those known commercially as VITON A®; (2) a class of terpolymers of vinylidenefluoride, hexafluoropropylene, and tetrafluoroethylene known commercially as VITON B®; and (3) a class of tetrapolymers of vinylidenefluoride, hexafluoropropylene, tetrafluoroethylene, and cure site monomer known commercially as VITON GH® or VITON GF®.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

Examples of fluoropolymers useful as the sheath or coating on the polymer fiber core include fluoroplastics. Fluoroplastics suitable for use herein include fluoropolymers comprising a monomeric repeat unit that is selected from the group consisting of vinylidene fluoride, hexafluoropropylene, tetrafluoroethylene, perfluoroalkylvinylether, and mixtures thereof. Examples of fluoroplastics include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof.

The siloxyfluorocarbon network (SFC) incorporated within and on top of the electrospun non-woven fiber matrix is comprised of alkoxysilane precursors. The mole ratios of the alkoxysilane precursors can be varied resulting in a highly tunable system. The alkoxysilane precursors can be incorporated into a liquid coating formulation which can be spray or flow coated from non-fluorinated solvents directly onto polymer fiber matrix and cured at temperatures at or below 180° C.

The siloxyfluorcarbon networked polymer is formed via sol-gel chemistry. The siloxyfluorocarbon networked polymer can withstand high temperature conditions without melting or degradation and is mechanically robust under fusing conditions.

Monofunctional, difunctional, or trifunctional silane end groups may be used to prepare a siloxyfluorocarbon networked polymer. Siloxyfluorocarbon monomers are represented by the structure:

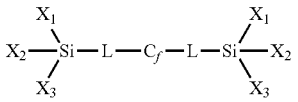

wherein $C_f$ is a linear aliphatic or aromatic fluorocarbon chain having from 2 to 40 carbon atoms; L is a $C_nH_{2n}$ group, where n is a number between 0 and about 10; and $X_1$, $X_2$, and $X_3$ are reactive hydroxide functionalities, reactive alkoxide functionalities, unreactive aliphatic functionalities of from about 1 carbon atom to about 10 carbon atoms, unreactive aromatic functionalities of from about 1 carbon atom to 10 carbon atoms wherein all siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers.

In addition to the monomers listed above, the siloxyfluorocarbon networked polymer can be prepared using monomers having the following structure:

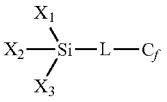

wherein $C_f$ represents a linear or branched aliphatic or aromatic fluorocarbon chain having from about 2 to 40 carbon atoms; L is a $C_nH_{2n}$ group, where n is a number between 0 and about 10, wherein m is between 1 and 3; and $X_1$, $X_2$, and $X_3$ are reactive hydroxide functionalities, reactive alkoxide functionalities, unreactive aliphatic functionalities of from about 1 carbon atom to about 10 carbon atoms or unreactive aromatic functionalities of from about 1 carbon atom to 10 carbon atoms and wherein all siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers.

In addition to the monomers listed above, the siloxyfluorocarbon networked polymer can be prepared using monomers that include non-fluorinated silane monomers selected from the group consisting of silicon tetraalkoxide and branched pentasilanes. The silicon tetraalkoxide is represented;

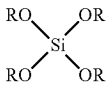

where R may be hydrogen, methyl, ethyl, propyl, isobutyl, other hydrocarbon groups, or mixtures thereof.

The branched pentasilanes may be generally represented by the respective structure:

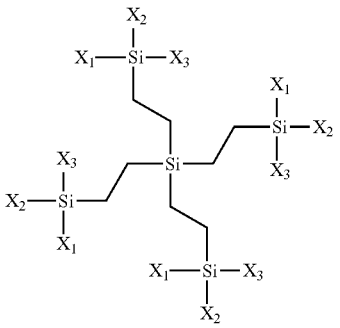

where $X_1$, $X_2$, and $X_3$ are as defined above.

The siloxyfluorocarbon networked polymer comprises a fluorine content of between about 20 weight percent to about 70 weight percent or from about 25 weight percent to about 70 weight percent or from about 30 weight percent to about 60 weight percent. The silicon content, by weight, in the siloxyfluorocarbon networked polymer is from about 1 weight percent silicon to about 20 weight percent silicon, or from about 1.5 weight percent silicon to about 15 weight percent silicon or from about 2 weight percent silicon to about 10 weight percent silicon.

The monomers are networked together so that all monomers are molecularly bonded together in the cured coating via silicon oxide (Si—O—Si) linkages. Therefore, a molecular weight can not be given for the siloxyfluorocarbon networked polymer because the coating is crosslinked into one system.

Solvents used for sol gel processing of siloxyfluorocarbon precursors and coating of layers include organic hydrocarbon solvents, and fluorinated solvents. Exemplary coating solvents include alcohols such as methanol, ethanol, isopropanol, and n-butanol are typically used to promote sol gel reactions in solution. Further examples of solvents include ketones such as methyl ethyl ketone, and methyl isobutyl ketone. Mixtures of solvents may be used. The solvent system included the addition of a small portion of water, such as from about 1 molar equivalent to 10 molar equivalents of water compared to the total molar equivalents of silicon, or from about 2 molar equivalents to about 4 molar equivalents of water.

Upon the addition of water to the solution of sol gel precursors, alkoxy groups react with water, and condense to form agglomerates that are partially networked, and are referred to as a sol. Upon coating of the partially networked sol onto the non-woven polymer fiber matrix, a gel is formed upon drying, and with subsequent heat treatment, the fully networked SFC coating (siloxyfluorocarbon networked polymer) is formed within the polymer fiber matrix and on top of the polymer fiber matrix.

A siloxyfluorocarbon networked polymer does not dissolve when exposed to solvents (such as ketones, chlorinated solvents, ethers etc.) and does not degrade at temperatures up to 250° C., and is stable at higher temperatures, depending on the system. The siloxyfluorocarbon networked polymer exhibits good release when exposed to toner or other contaminants, so that toner and other printing-related materials do not adhere to the fusing member.

The cross-linked SFC polymer does not have a melting point or a glass transition temperature (Tg). The surface repair is dependent on the rate at which POSS can diffuse through the matrix to the surface. It is more dependent on cross-link density which is dependent on SFC formulation.

In an embodiment, one can use metal alkoxide (M=Si, Al, Ti etc.) functionalities as cross-linking components between fluorocarbon chains. For cross-linking to occur efficiently throughout the composite, bifunctional fluorocarbon chains are used. Mono-functional fluorocarbon chains can also be added to enrich fluorination content. $CF_3$-terminated chains align at the fusing surface to reduce surface energy and improve release.

Examples of precursors that may be used to form a composite system include silicon tetraalkoxide and siloxane-terminated fluorocarbon chains and are shown below. Siloxane-based sol-gel precursors are commercially available. The addition of a silicon tetraalkoxide (such as a silicon tetraalkoxide, below) introduces extra cross-linking and robustness to the material, but is not necessary to form the sol-gel/fluorocarbon composite system.

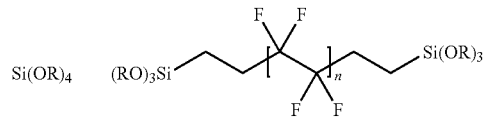

Silicon Tetraalkoxide  Siloxane-terminated Fluorocarbon Chains

Fluorocarbon chains include readily available dialkene precursors which can then be converted to silanes via hydrosilation (Reaction 1) yielding. Monofunctional fluorinated siloxane chains are commercially available as methyl or ethyl siloxanes, or could be converted from chlorosilane or dialkene precursors.

Reacation 1: Preparation of fluorinated alkoxysilane precursors.

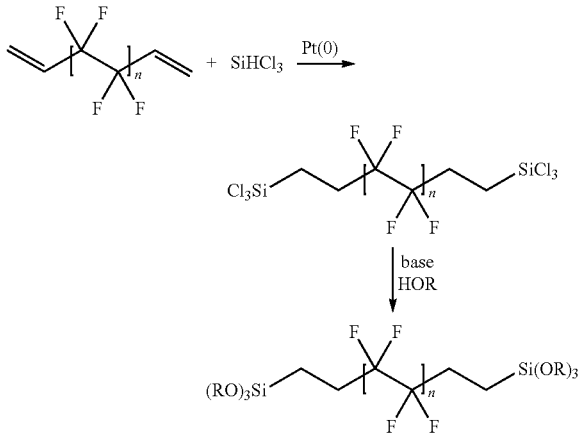

The alkoxysilane precursors can be varied resulting in a highly tunable system and are typically spray or flow coated from non-fluorinated solvents directly onto polymer fiber matrix and cured at temperatures at or below 180° C. The formation of the networked SFC within and on top of the polymer fiber matrix is shown below.

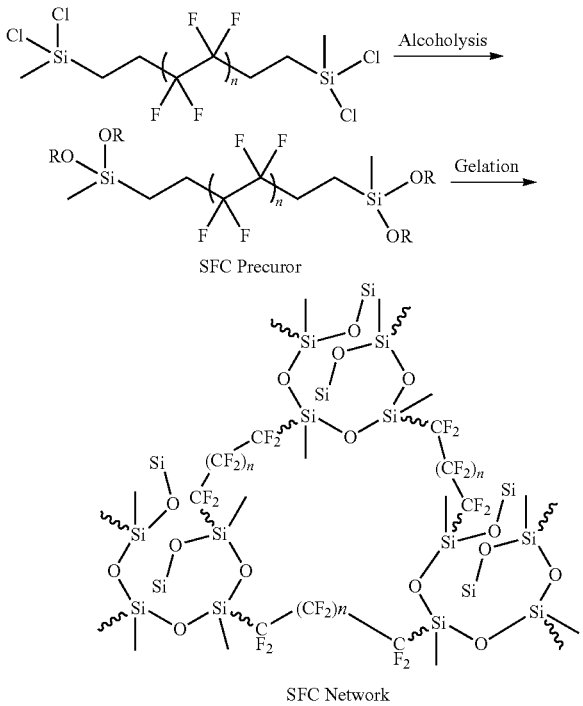

Polyhedral oligomeric silsesquioxanes (POSS) with longer perfluoroalkyl substituents are chemically similar to the SFC networked polymer enabling dissolution and dispersion of the POSS within the SFC matrix. They are the most hydrophobic crystalline solid materials known and incorporation into the SFC networked polymer matrix lowers the surface free energy (SFE) and improves toner release. Furthermore, the low melting point of these perfluorinated POSS materials means the POSS will be in the melt phase during fusing which can result in 'sustained release' of toner as POSS migrates and replenishes and repairs the surface layer of the fuser.

The fluorinated polyhedral oligomeric silsesquioxane is represented by:

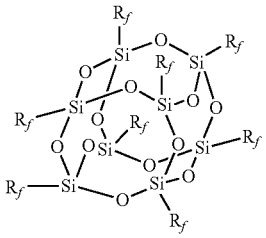

wherein $R_f$ is a linear aliphatic or aromatic fluorocarbon chain having from 2 to 40 carbon atoms. In embodiments $R_f$ is $CH_2CH_2CF_2CF_2CF_2CF_3$ (fluorohexyl) or $CH_2CH_2CF_2CF_2CF_2CF_2CF_2CF_3$ (fluorooctyl) or $CH_2CH_2CF_2CF_2CF_2CF_2CF_2CF_2CF_2CF_3$ (fluorodecyl).

The weight ratio of fluorinated polyhedral oligomeric silsesquioxane in SFC networked polymer is from about 1 weight percent to about 30 weight percent or from about 2 weight percent to about 25 weight percent or from about 5 weight percent to about 20 weight percent. The addition of fluorinated polyhedral oligomeric silsesquioxane to the SFC matrix improves performance of the surface layer.

The non-woven matrix of polymer fibers and having a networked siloxyfluorocarbon polymer and fluorinated POSS dispersed throughout has a thickness of from about 10 μm to about 400 μm, or from about 20 μm to about 300 μm, or from about 25 μm to about 200 μm.

The release layer of the SFC and fluorinated POSS dispersed in the non-woven polymer matrix has a surface energy of from about 8 mN/m to about 22 mN/m or from about 10 mN/m to about 20 mN/m or from about 12 mN/m to about 18 mN/m. The release layer is repaired or refurbished when heated a temperature of from about 130° C. or greater for a time of greater than 1 minute.

Specific embodiments will now be described in detail. These examples are intended to be illustrative, and not limited to the materials, conditions, or process parameters set forth in these embodiments. All parts are percentages by solid weight unless otherwise indicated.

EXAMPLES

A core-sheath fiber mat was applied onto a silicone substrate of a fuser member via electrospinning process. The fiber core is a fluorinated polyimide (FPI) synthesized from 6FDA (hexafluoroisopropylidene bisphthalic dianhydride) and TFMB (2,2'-bis(trifluoromethyl)benzidine). The sheath is a fluoroelastomer (Viton-GF®) crosslinked by an aminosilane (AO700 curing agent, N-(2-aminoethyl)-3-aminopropyltrimethoxysilane). The core solution was prepared as 8 weight percent of FPI in 1:1 DMAc/$CH_2Cl_2$ and the sheath solution was prepared as 8 weight percent of Viton-GF® in MEK with 5 weight percent AO700 relative to the Viton-GF®. Both solutions were delivered with syringe pumps. The flow rate was 0.70 mL/hr for the core solution and 1.40 mL/hr for the sheath solution. Total amount of dispensed solution was 5 mL for the core and 10 mL for the sheath. A voltage of 20 kV was used during coaxial electrospinning and the distance between the co-axial nozzle and substrate was fixed at 15 cm. The resulting fiber mat was dried under ambient conditions overnight, then heat-treated by curing at ramp temperatures, e.g. at about 149° C. for about 2 hours, and at about 177° C. for about 2 hours, then at about 204° C. for about 2 hours, and then at about 232° C. for about 6 hours for a post cure. The fiber roll was used for further impregnation coating with SFC materials.

Fluorohexyl polyhedral oligomeric silsesquioxane was synthesized. Stable (greater than 1 hour pot life) sol formulations were prepared that contained SFC and from about 10 to about 20 weight percent of the fluorohexyl polyhedral oligomeric silsesquioxane. The formulations were flow coated onto silicone fuser roll substrates described above. The final coating was left to gel, and was then dried and cured at 180° C. for 1 hour.

The contact angle (water, dimethylformamide, and diiodomethane) and SFE of SFC/fluorohexyl-polyhedral oligomeric silsesquioxane (FHP) coated on a fuser substrate is shown in Table 1. Comparison of the SFC/FHP/fiber composite coatings show there is a dramatic decrease in SFE relative to SFC or SFC/FHP alone. The SFC/FHP/fiber composites have SFE equal to or less than that of PFA.

TABLE 1

| Material | Substrate | Coating Method | Contact Angle (°) Water | DMF | $CH_2I_2$ | SFE (mN/m) |
|---|---|---|---|---|---|---|
| PFA | — | — | — | — | — | ~17 |
| SFC | Polyimide | Draw Down | 97.3 | 79.1 | 67.0 | 25.1 |
| SFC/10% FHP | Silicone | Flow | 102.4 | 89.9 | 66.7 | 27.5 |
| SFC/10% FHP/fiber | Silicone | Flow | 114.4 | 106.6 | 86.1 | 17.2 |
| SFC/20% FHP/fiber | Silicone | Flow | 109.0 | 103.9 | 94.5 | 11.9 |

To demonstrate polyhedral oligomeric silsesquioxane migration results in surface repair, a free-standing segment of SFC/FHP/fiber composition was prepared and artificially damaged by plasma treatment (air gas), then heated at elevated temperature. The water contact angle was measured prior to plasma treatment (time zero), approximately 1 hour after plasma treatment, and immediately following baking at 160° C. for 10 min. At time zero the water contact angle was 120°. Immediately following plasma treatment the water contact angle dropped to 0° (surface was completely hydrophilic). After a relaxation period of 1 hour the water contact angle was found to be about 90°. Following heat treatment the water contact angle returned to 120° indicating heating of the damaged sample resulted in repair of the surface. As a control, the fiber mat alone and SFC alone were exposed to a damage/heat cycle. These surfaces could not be repaired by heat treatment after plasma damage (water contact angle remained low).

After damage, heat treatment of the coating layer increases the fluorinated polyhedral oligomeric silsesquioxane mobility allowing the fluorinated polyhedral oligomeric silsesquioxane to migrate to the air/surface interface and restore the surface to its original state. As the fluorinated polyhedral oligomeric silsesquioxane molecules are surrounded by the highly networked SFC their mobility is restricted and the coating is stable at elevated temperature (complete phase separation is not observed).

Figure 6:
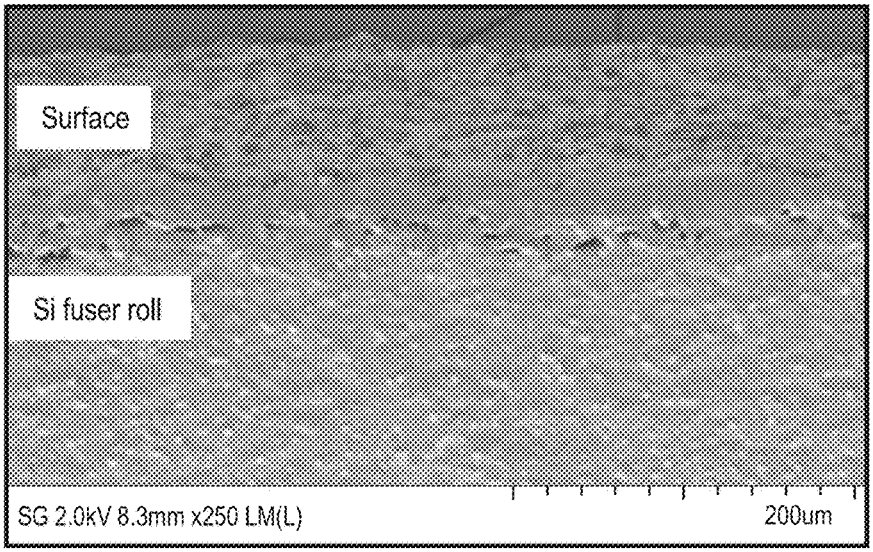
FIG. 6 is an SEM image of an embodiment of a release layer on a fuser member.

In FIG. 6, the SEM image shows the SFC/fluorinated polyhedral oligomeric silsesquioxane material has penetrated through the polymer fiber matrix. The coating thickness of the polymer fiber matrix having SFC/fluorinated polyhedral oligomeric silsesquioxane dispersed throughout is about 50 μm. The SEM image reveals the SFC/fluorinated polyhedral oligomeric silsesquioxane polymer thoroughly penetrated the fiber network.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A fuser member comprising:

a substrate; and a surface layer disposed on the substrate, the surface layer comprising a non-woven polymer fiber matrix having dispersed throughout a siloxyfluorocarbon (SFC) networked polymer and a fluorinated polyhedral oligomeric silsesquioxane, wherein the surface layer has a thickness of from about 10 μm to about 400 μm.

2. The fuser member of claim 1, wherein the siloxyfluorocarbon networked polymer is formed from siloxyfluorocarbon monomers represented by:

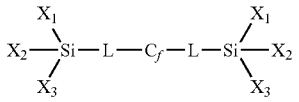

wherein $C_f$ is a linear aliphatic or aromatic fluorocarbon chain having from 2 to 40 carbon atoms; L is a $C_nH_{2n}$ group, where n is a number between about 0 and about 10; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to 10 carbon atoms wherein all of the siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers.

3. The fuser member of claim 2, wherein the siloxyfluorocarbon monomers further comprise monomers represented by:

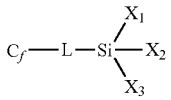

wherein $C_f$ is a linear or branched aliphatic or aromatic fluorocarbon chain having from about 2 to about 40 carbon atoms; L is a $C_nH_{2n}$ group, where n is a number between 0 and about 10, wherein m is between 1 and 3; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to about 10 carbon atoms.

4. The fuser member of claim 1, wherein the fluorinated polyhedral oligomeric silsesquioxane is represented by:

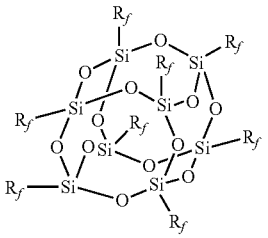

wherein $R_f$ is a linear aliphatic or aromatic fluorocarbon chain having from about 2 to about 40 carbon atoms.

5. The fuser member of claim 1, wherein the surface layer can be repaired when heated to a temperature of greater than 130° C. for a time of greater than 1 minute.

6. The fuser member of claim 1, wherein the non-woven polymer fiber matrix comprises a polymer selected from the group consisting of: polyamide, polyester, polyimide, polycarbonate, polyurethane, polyether, polyoxadazole, polybenzimidazole, polyacrylonitrile, polycaprolactone, polyethylene, polypropylenes, acrylonitrile butadiene styrene (ABS), polybutadiene, polystyrene, polymethyl-methacrylate (PMMA), poly(vinyl alcohol), poly(ethylene oxide), polylactide, poly(caprolactone), poly(ether imide), poly (ether urethane), poly(arylene ether), poly(arylene ether ketone), poly(ester urethane), poly(p-phenylene terephthalate), cellulose acetate, poly(vinyl acetate), poly(acrylic acid), polyacrylamide, polyvinylpyrrolidone, hydroxypropylcellulose, poly(vinyl butyral), poly(alkly acrylate), poly (alkyl methacrylate), polyhydroxybutyrate, fluoropolymer, poly(vinylidene fluoride), poly(vinylidene fluoride-co-hexafluoropropylene), fluorinated ethylene-propylene copolymer, poly(tetrafluoroethylene-co-perfluoropropyl vinyl ether), poly((perfluoroalkyl)ethyl methacrylate), cellulose, chitosan, gelatin, protein, and mixtures thereof.

7. The fuser member of claim 1, wherein surface layer has a water contact angle of greater than about 100°.

8. The fuser member of claim 1, wherein surface layer has a surface energy of less than 22 mN/m.

9. The fuser member of claim 1, wherein the polymer fibers of the non-woven polymer fiber matrix have a diameter of from about 100 nm to about 1 μm.

10. The fuser member of claim 1, wherein the polymer fibers of the non-woven polymer fiber matrix have a fluoropolymer sheath.

11. The fuser member of claim 1, further comprising an intermediate layer disposed between the surface layer and the substrate wherein the intermediate layer comprises an elastomer.

12. The fuser member of claim 1, wherein the fluorinated polyhedral oligomeric silsesquioxane comprises from about 1 weight percent to about 30 weight percent of the SFC and the fluorinated polyhedral oligomeric silsesquioxane.

13. A fuser member comprising:

a substrate;

an intermediate layer disposed on the substrate; and a surface layer disposed on the intermediate layer, the surface layer comprising a non-woven polyimide fiber matrix, including fibers having a diameter of from about 100 nm to about 1 μm, having dispersed throughout a siloxyfluorocarbon (SFC) networked polymer and a fluorinated polyhedral oligomeric silsesquioxane, wherein the siloxyfluorocarbon networked polymer is formed from siloxyfluorocarbon monomers represented by:

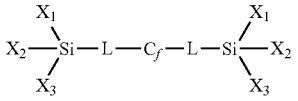

wherein $C_f$ is a linear aliphatic or aromatic fluorocarbon chain having from about 2 to about 40 carbon atoms; L is a $C_nH_{2n}$ group, where n is a number between about 0 and about 10; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to 10 carbon atoms wherein all of the siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers and the fluorinated polyhedral oligomeric silsesquioxane is represented by:

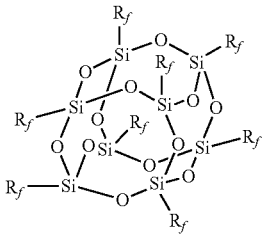

wherein $R_f$ is a linear aliphatic or aromatic fluorocarbon chain having from 2 to 40 carbon atoms, wherein the surface layer has a thickness of from about 10 μm to about 400 μm.

14. The fuser member of claim 13, wherein the siloxyfluorocarbon monomers further comprise monomers represented by:

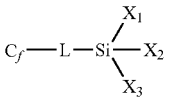

wherein $C_f$ is a linear or branched aliphatic or aromatic fluorocarbon chain having from about 2 to about 40 carbon atoms; L is a $C_nH_{2n}$ group, where n is a number between about 0 and about 10, wherein m is between 1 and 3; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to 10 carbon atoms.

15. The fuser member of claim 13, wherein the surface layer can be repaired when heated to a temperature of greater than 130° C. for a time of about 1 minute.

16. A fuser member comprising:

a substrate;

a silicone layer disposed on the substrate; and a surface layer disposed on the silicone layer, the surface layer comprising a non-woven polyimide fiber matrix, including polyimide fibers having a diameter of from about 100 nm to about 1 μm, wherein polyimide fibers of the non-woven polymer fiber matrix comprise the following chemical structure:

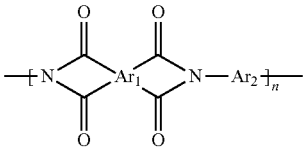

wherein $Ar_1$ and $Ar_2$ independently represent an aromatic group of from about 4 carbon atoms to about 100 carbon atoms; and at least one of $Ar_1$ and $Ar_2$ further includes a fluoro-pendant group wherein n is from about 30 to about 500; having dispersed throughout a siloxyfluorocarbon (SFC) networked polymer and a fluorinated polyhedral oligomeric silsesquioxane, wherein the surface layer has a thickness of from about 10 μm to about 400 μm.

17. The fuser member of claim 16, wherein the siloxyfluorocarbon networked polymer is formed from siloxyfluorocarbon monomers represented by:

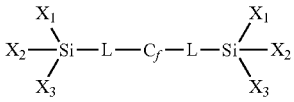

wherein $C_f$ is a linear aliphatic or aromatic fluorocarbon chain having from about 2 to 40 carbon atoms; L is a $C_nH_{2n}$ group, where n is a number between about 0 and about 10; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to 10 carbon atoms wherein all of the siloxyfluorocarbon monomers are bonded together via silicon oxide (Si—O—Si) linkages in a single system and wherein the siloxyfluorocarbon networked polymer is insoluble in solvents selected from the group consisting of ketones, chlorinated solvents and ethers.

18. The fuser member of claim 16, wherein the siloxyfluorocarbon monomers further comprise monomers represented by:

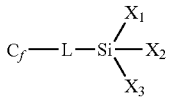

wherein $C_f$ is a linear or branched aliphatic or aromatic fluorocarbon chain having from about 2 to about 40 carbon atoms; L is a $C_nH_{2n}$ group, where n is a number between 0 and about 10, wherein m is between 1 and 3; and $X_1$, $X_2$, and $X_3$ are selected from the group consisting of: reactive hydroxide functionalities, reactive alkoxide functionalities, unreactive aliphatic functionalities of from about 1 carbon atom to about 10 carbon atoms and unreactive aromatic functionalities of from about 1 carbon atom to 10 carbon atoms.

19. The fuser member of claim 16, wherein the fluorinated polyhedral oligomeric silsesquioxane is represented by:

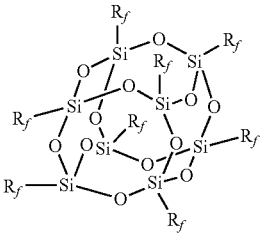

wherein $R_f$ is a linear aliphatic or aromatic fluorocarbon chain having from about 2 to about 40 carbon atoms.

* * * * *